United States Patent [19]

Ekmark

[11] Patent Number: 4,528,835

[45] Date of Patent: Jul. 16, 1985

[54] ROOFING FOR BUILDING AND METHOD AND APPARATUS FOR MAKING THE ROOFING

[75] Inventor: Bo Ekmark, Luleå, Sweden

[73] Assignee: Techtrans Company, Ltd., St. Helier, Channel Islands

[21] Appl. No.: 586,657

[22] Filed: Mar. 9, 1984

Related U.S. Application Data

[63] Continuation of Ser. No. 354,037, Mar. 2, 1982, abandoned, which is a continuation-in-part of Ser. No. 219,831, Dec. 24, 1980, Pat. No. 4,320,648, which is a continuation of Ser. No. 955,217, Oct. 27, 1978, abandoned.

[30] Foreign Application Priority Data

Mar. 10, 1981 [SE] Sweden ..... 8101521

[51] Int. Cl.[3] ..... B21D 13/10

[52] U.S. Cl. ..... 72/301; 72/379; 72/380

[58] Field of Search ..... 72/177, 301, 306, 307, 72/308, 309, 311, 312, 318, 379, 380, 381, 415, 416; 52/314, 519, 536, 537, 556

[56] References Cited

U.S. PATENT DOCUMENTS

| | | | |
|---|---|---|---|
| 95,990 | 10/1869 | Crowley | 52/630 |
| 600,606 | 3/1898 | Bayer | 52/536 |
| 1,226,564 | 5/1917 | Miller | 52/537 |
| 2,670,779 | 3/1954 | Mowrey | 72/301 |
| 2,901,951 | 9/1959 | Hochfeld | 428/603 |
| 3,000,423 | 9/1961 | Aris | 72/301 |
| 3,340,719 | 9/1967 | Kandle et al. | 72/397 |
| 3,485,002 | 12/1969 | Baker | 52/314 |
| 4,250,728 | 2/1981 | King | 72/177 |

FOREIGN PATENT DOCUMENTS

| | | | |
|---|---|---|---|
| 2551505 | 5/1976 | Fed. Rep. of Germany | 52/555 |
| 58898 | 11/1953 | France . | |
| 999331 | 11/1953 | France . | |
| 2305563 | 10/1976 | France | 52/519 |
| 580572 | 9/1946 | United Kingdom | 52/314 |

*Primary Examiner*—Lowell A. Larson

*Attorney, Agent, or Firm*—LeBlanc, Nolan, Shur & Nies

[57] ABSTRACT

A method of and apparatus for manufacturing a roofing of sheet metal, where a sheet in a first step is preformed so as by a first operation perpendicular to its surface extension, the sheet is provided with a contour of wave-shape and in a second step, is provided with step-shaped jags of a predetermined step height by means of a pressing tool, which comprises at least one first and one second pair of tools movable to and from each other, the preformed sheet being held down by each tool pair, whereafter the tool pairs are moved relative to each other through a distance corresponding to the step height, so that the sheet by the second operation which is in a direction perpendicular to the surface extension of the sheet and to said first cut is provided with a step-shaped portion across the wave-shaped sheet, whereafter as a third operational step, the preformed sheet is advanced through a predetermined adjusted distance, and thereafter the second operational step is repeated to make a next step in the sheet. The second tool pair, at the discharge end of the pressing tool, has a clamping force sufficient to prevent sliding movement between the sheet and the second tool pair. The first tool pair, at the feed end of the pressing tool, holds down the sheet with a lower clamping force so adjusted that sliding movement between the sheet and the tool surfaces of the first pair takes place when a tensile stress has been attained in the sheet by the relative movement of the tool pairs which is higher than the yield strength of the sheet.

17 Claims, 12 Drawing Figures

ROOFING FOR BUILDING AND METHOD AND APPARATUS FOR MAKING THE ROOFING

This application is a continuation of application Ser. No. 354,037, filed Mar. 2, 1982, now abandoned, which is a continuation-in-part application of U.S. patent application Ser. No. 219,831, filed Dec. 24, 1980, now U.S. Pat. No. 4,320,648 granted Mar. 23, 1982, which is a Rule 60 continuation application of U.S. patent application Ser. No. 955,217, filed Oct. 27, 1978 abandoned.

BACKGROUND OF THE INVENTION

Roofs at present are covered with many different materials, for example tiles and sheets. Tile roofs are attractive, and many private persons want the roofs of their own homes be covered with tiles. Tiles, however, are expensive, and moreover, the art field, i.e., the manufacture of roof tiles, is gradually ceasing to exist due to lack of profitability, factors which will result in a future shortage of roof tiles.

The tin (metal) roofs available prior to applicant's invention consist of flat sheets or of conventionally roll-formed sheets of different appearance, or of trapezoid corrugated sheets, and the like.

The present invention refers to a kind of sheet-tile roof, which means that the roofing consists of sheets, but has the appearance of tiles, and will be referred to hereinafter as tiles. The new sheet-tile roof is manufactured in large units which include a plurality of "tiles", so that several rows of tiles are obtained in both directions, vertically as well as in lateral direction. The large units then can be cut to desired sizes. The individual "tile" in the large unit, besides, can be manufactured in different sizes (modules) according to desire. This new roofing is cheaper to manufacture and cheaper to lay (mount) on the roof than a conventional clay or ceramic tile roof. It has the look, besides, of a usual tile roof and, therefore, the new roofing also is attractive to many people. The new roofing also is attractive compared with conventional roofing of sheet material, because of the appearance of a clay tile roof. The new roofing, besides, has economically advantageous aspects in production, shipping, storage and installation.

My co-pending application Ser. No. 219,831 discloses a roofing, the appearance of which resembles that of a clay tile roofing. The method of manufacturing such roofing which also is described in said patent specification is characterized substantially in that a flat sheet in a first step is preformed by roll-forming, so that the sheet by a first cross forming operation is provided with a contour perpendicularly to its surface extension which in cross-section is a curved, or multi-wave shape, e.g., a sinus-shaped section. In a second step the preformed sheet is provided with stepped jags of a certain step height by some kind of stretch-pressing operation, at which a special pressing tool is used. The basic pressing tool comprises two pairs of tools, which are movable individually relative to each other in a direction perpendicular to the surface extension of the sheet. At the forming of the step-like jag the preformed sheet is held down, retained, by each pair of tools in a clamping condition, i.e., in a blankholding condition, whereafter the tool pairs are moved relative to each other through a distance corresponding to the step height, so that the sheet by the second forming operation perpendicularly to its surface extension and to said first cut is given a step-formed section.

The tools then are separated from each other, and the sheet is advanced through a predetermined distance. Thereafter the next step is formed, and so on.

The result thereof is a sheet having a form corresponding to a portion of a clay tile roof.

The method referred to above, however, involves problems, viz. that the distance between two subsequent jags, i.e. a distance corresponding to the length of a tile, is difficult to control. Furthermore, uncontrolled wrinkling and/or tearing occurring in connection with making the jag is difficult to avoid. These problems emanate from difficulties in controlling and guiding the movements of the sheet relative to the tool surfaces of the tool pairs. This in its turn depends on the clamping force with which the two respective tool pairs are held against the sheet.

SUMMARY OF THE INVENTION

The present invention provides a solution of these problems and, thus, proposes a method, by which a sheet can be formed so as to assume the appearance of tile roof, where the distance between two subsequent jags always is the same, and wrinkling and tearing in connection to the jag is avoided.

The equal distance between two subsequent jags is a factor of extreme importance, because the sheets can be manufactured in lengths from ridge to eave for fast and easy installation and several sheets will be required for covering a roof. Each sheet must accurately adjoin the adjacent sheets for rendering the roof tight. The equal distance of the tile lengths, is essential from an aesthetic point of view, because the roof should look like a clay tile roof.

The present invention, thus, relates to a method of manufacturing a roofing of metal sheet where in a first step a sheet is preformed so as by a first operation perpendicularly across its surface extension be given a portion curved to wave-shape, for example sinus shape, and the preformed sheet in a second step is provided with stepped jags of a predetermined step height by means of a pressing tool, which comprises at least one first and one second pair of tools movable to and from each other, the preformed sheet being held down by each pair of tools, which pairs are thereafter moved relative to each other through a distance corresponding to the step height, so that the sheet by a second cut or operation perpendicular to its surface extension as well as to said first cut is given a step-shaped portion, whereafter the preformed sheet is advanced through a predetermined adjusted distance, and thereafter the next step is formed and so on. The invention is characterized in that said second tool pair located at the discharge end of the pressing tool is caused to hold down the sheet with such clamping force, that sliding between the sheet and the tool surfaces is prevented, and said first tool pair located at the feed end of the pressing tool is caused to hold down the sheet with a lower clamping force so adjusted that sliding between the sheet and the surfaces of the first pair of tools during the stretch-pressing operation takes place when a tensile stress has been attained in the sheet by the relative movement of the tool pairs which is higher than the yield strength but still lower than the ultimate strength of the sheet.

Further, the present invention relates to an apparatus for manufacturing a roofing of metal sheet by a stretch-pressing operation out of a preformed curved sheet metal, for example a sinu-soidal curved sheet metal, with full waves across the width to simulate appearance of a tile, characterized in that at least two structurally independent pairs of pressing and clamping tools are mounted for independent clamping operation, where each of the pairs comprises one lower part and one upper part and where the surface of each tool part facing the corresponding lower or upper part has a shape corresponding to the shape of the preformed sheet so that adjacent portions of such a sheet can be retained by pressure exerted by one upper and one lower part of each pair of tools when that pair is moved to clamp the sheet; said two pairs of tools being mounted for movement, while in clamping condition, a preselected distance relative to each other, said movement between the two pairs of tools taking place in a plane perpendicular to the surface extension of a retained preformed sheet.

Further novel features and other objects of this invention will become apparent from the following detailed description, discussion and the appended claims taken in conjunction with the accompanying drawings.

BRIEF DESCRIPTION OF DRAWINGS

A preferred structural embodiment of this invention is disclosed in the accompanying drawings, in which.

GENERAL DESCRIPTION OF DRAWINGS

Figure 1:
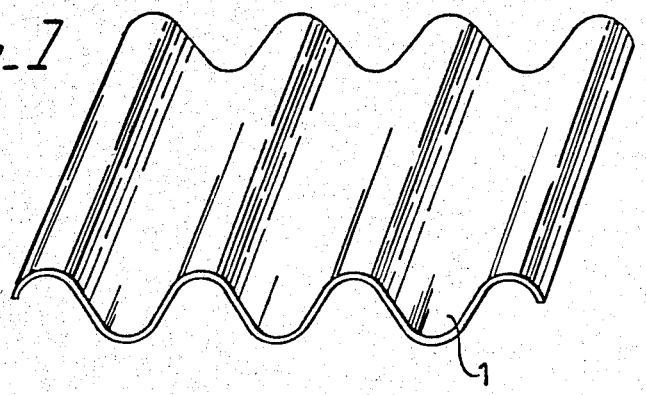
FIG. 1 shows a portion of a preformed sheet, with a wave-shaped lateral cross-section.
Figure 2:
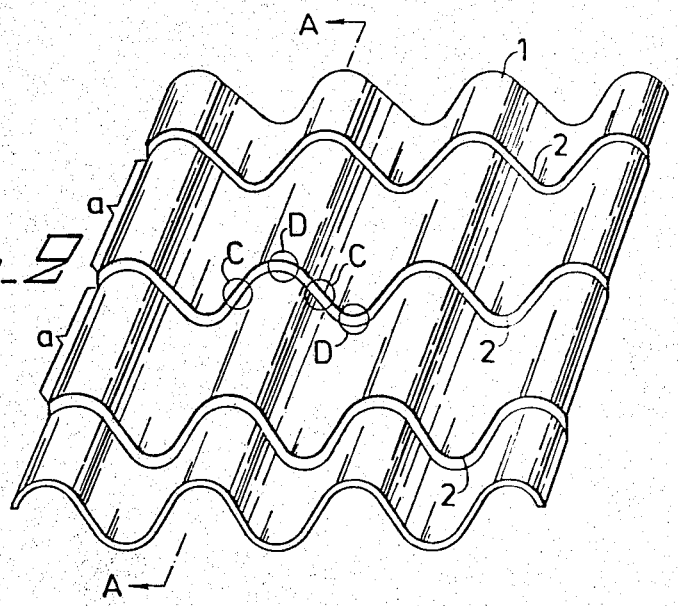
FIG. 2 shows a portion of a completely formed sheet.

In FIG. 1 a portion of a sheet 1 is shown which has been preformed by pressing or roll-forming, whereby the sheet has been given a desired wave-shape, for example sinus-shaped cross-section. Note, other suitable shapes are garland-shaped waves (Dutch style tiles) and arch-shaped waves (Spanish style tiles). The sheet thus formed is provided by the method to be described below with stepped jags 2 perpendicular to the main or longitudinal extension plane or surface of the sheet across the wave shaped direction, see FIGS. 2 and 3.

The size of the individual "tiles" can be varied both in lateral and vertical direction. The number of tile rows, too, can be varied in both directions.

Figure 3:
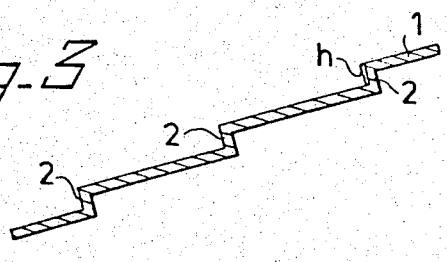
FIG. 3 is a section of the sheet in FIG. 2 along the line A—A.

FIG. 3 shows sheet-tiles seen from the side where also said jags are shown, which correspond to the overlapping in height between two common roof tiles. The jags corresponding to the lateral overlapping between two common roof tiles is obtained by the shape of the roll-formed sheet according to above.

Figure 9:
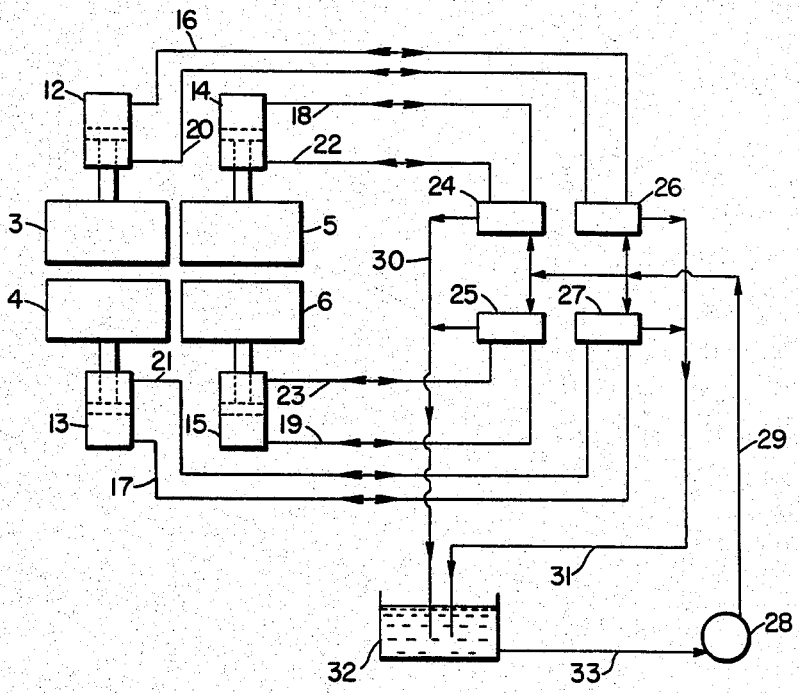
FIG. 9 schematically shows a hydraulic system for driving the tools shown in FIGS. 6*a–6d.*

For carrying out the method, two pairs of tools 3, 4 and, respectively, 5, 6 are provided. Each tool 3–6 is movable to and from the opposed tool of its respective pair by hydraulic piston cylinders or corresponding power producing means, see FIGS. 4 and 9. Each tool has a tool surface 10, 11 of a configuration corresponding to the form of the preformed sheet 1, see FIG. 5. The two tools 3, 4, and respectively, 5, 6 in each of said pairs have tool surfaces of complementary configuration relative to each other so as to fit into each other, see FIG. 5.

When the preformed sheet has been positioned in the tool, the sheet first is secured by being pressed between the two parts to the left and between the two parts to the right of the tool. In each of the pairs the relative position between the two tools in each pair are thereafter held constant, which is necessary for the continued operation.

The proper jag formation is brought about in that, for example, the right-hand tool half is moved downward (see FIG. 6*c*) through a distance h, i.e. one jag is formed at a time. The movement of the tool, as described hereinafter, parts can be effected by separate inter-related movements for the different tool parts, under pre-determined control of operating pressures applied to the respective separate piston-cylinder motors.

Figure 7:
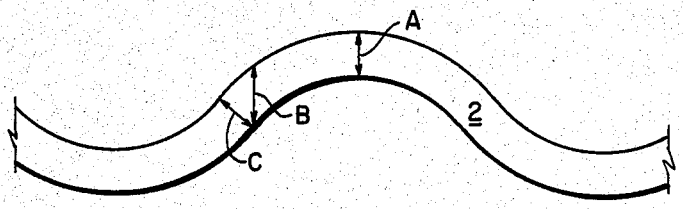
FIG. 7 shows the horizontal portion of a step, corresponding to the vertical overlapping at two conventional roof tiles.
Figure 8:
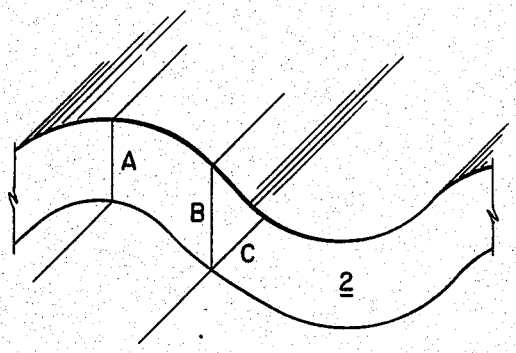
FIG. 8 shows a perspective view of the portion shown in FIG. 7.

FIG. 7 shows the horizontal portion of the jag, i.e. that portion which corresponds to the vertical overlapping at two common roof tiles. FIG. 8 is a perspective view of the same detail.

When the jag is being formed, the sheet is stretched differently in the parts A and BC, if the height A equals the height B, whereby uncontrolled wrinkling and/or tearing will occur. In order to avoid such uncontrolled formations, the tool can be designed in different ways.

It is impossible to make the wave form at the same time as the jags. The tile sheet roof has to be made in two steps. The first step is to form the sheet into the wave or sinus shape by roll-forming or pressing and the second step is to make the jags. The present invention refers to the second step.

It is also impossible to grip the sheet in such a way that the sheet is prevented from sliding relative to all tool surfaces and thereafter make the jag by stretching only, because no commercially available or for this purpose suitable sheet material is so ductile that it can be elongated 50–200 per cent, which is necessary to make the jag height up to 30 times the thickness, without tearing. Elongation for the most commercial sheet materials are in the range of 15–30 per cent maximum.

The sheet metal preferably used has a thickness of only 0.4 to 1.0 mm.

After the sheet has been preformed into a sinus or a sinu-soidal shape, the preformed sheet is put into the press tool assembly. This assembly is, as said above, built up by four independent tool blocks arranged in two pairs. In the tool assembly the preformed sheet is held by each of the pairs of tools by clamping, i.e. in a blank holding condition.

Thereafter one pair of tools is vertically moved in parallel relation to the other tool pair and the jag is thereby formed, by means of a stretch-pressing operation. The definition of said term "stretch-pressing operation" is that the material both slides relative to the tool surfaces and is deformed. In order to obtain a jag the sheet must be clamped so hard that the sheet does not start to slide relative to the tool surfaces until the tension in the sheet at the jag, i.e. the tensile tension in the direction of the jag-height, has reached a certain level. This level is below the tension at which tearing occurs. The level is, however, above the level at which stretching of the sheet occurs. When said tension level is reached the sheet starts to slide relative to the tool surfaces whereby sheet metal is fed into the jag forming zone at the same time as the sheet is deformed by pressing, whereby the jag is formed. Thus, the jag is formed by a combination of elongation of the sheet and slipping of the sheet relative to the tool surfaces.

However, said stretch-pressing operation is a necessary but not a sufficient condition for avoiding uncontrolled wrinkling and/or tearing.

Assuming that the preformed sheet metal is sinus shaped and that all four tool surfaces have a corresponding sinus shape, and that the height A equals the height B in FIGS. 7 and 8 after the two pairs of tools have been displaced relative to each other a distance h according to FIG. 6. What then happens is that, since A equals B and thereby the distance C is shorter than A and B, the sheet metal will tend to tear at A and/or tend to wrinkle at the area BC, in FIGS. 7 and 8. The area A is designated by rings D, and the area BC is designated by rings C in FIG. 2.

In order to accomplish the above said stretch-pressing operation and prevention of wrinkling and/or tearing, the tools must be designed in one of the following three ways or a combination of these.

According to the present invention the holding force can be varied across the shape of the tools so that the holding force is different in the area of A and BC respectively. Assuming that the height A equals the height B the holding force shall be greater in the area of BC than in the area of A. This is accomplished by grinding off material from the tool surfaces in the area of A whereby the tool surfaces in the area of A will deviate from a sinus shape. When the tool surface is clamping the sheet there will thus occur a greater holding force at BC than in A. The result of such tool design is that the sheet will slide more easily in the area of A than in the area of BC. More sheet material will thus be fed into the jag forming zone at A than at BC also resulting in some stretching of the sheet in a direction substantially 45° from the longitudinal direction of the sheet (the feeding direction of the sheet).

Said grinding shall be a very light grinding. As understood the grinding away of material of the tool part actually has the effect of lowering the friction force at the area of A compared to the area of BC. The maximum grinding is done at the top at A and is gradually decreased towards BC.

A second way according to the present invention is to design the tools in such way the height A equals the distance C, and equals all or substantially all distances of a formed jag perpendicular to the tool surfaces. Hereby, it is achieved that the necessary stretching and feeding in of sheet material to the jag forming zone is in average equal over the whole jag forming zone. According to this second way, the frictional conditions shall be equal over the whole tool surfaces.

Figure 4:
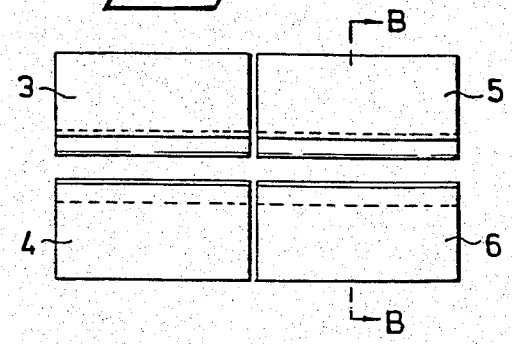
FIG. 4 shows a tool set.
Figure 5:
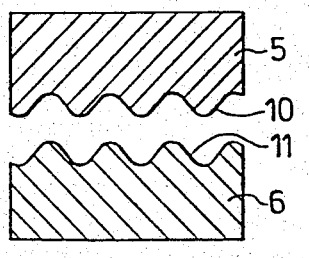
FIG. 5 is a section along the line B—B in FIG. 4.

The tools are according to this second way designed so that a certain displacement h gives that the distance between the lower tool surface of one pair of tools, the left pair in FIG. 6, and the upper tool surface of the other pair of tools, the right pair in FIG. 4, perpendicular to the tool surfaces is equal along the whole jag. The corresponding upper and lower tools respectively have a corresponding shape as the other tool in each pair.

This means that according to one embodiment one pair of tools has sinus shaped tool surfaces and the other pair has a tool shape deviating from a sinus shape according to the aforesaid description pertaining to light grinding away of tool material at the area denoted as A.

According to a further embodiment, each tool pair has tool surfaces deviating from a sinus shape to the same extent. When feeding in a preformed sinus shaped sheet metal, the sheet will thus be elastically deformed while clamped to a shape corresponding to the tool surfaces. However, the sheet metal will substantially assume a sinus shape after unloading.

A third way according to the present invention is to make impressions in the sheet metal at such places where wrinkling tends to occur. Assuming that the heights A and B are equal, wrinkling tends to occur in the area of BC. In such case the impressions shall be made in the area of BC. The impressions can be made in the jag, i.e. the part parallel to the direction of tool displacement, or in the sheet metal lying between the tool surfaces. Such impressions are made by parts extending from one tool and a corresponding recess in the corresponding other tool.

The above described method thus allows the sheet metal to slide relative to the tool surfaces. When a sheet is to be formed having several tiles in the vertical direction, several jags are to be formed in successive steps.

Figure 6A:
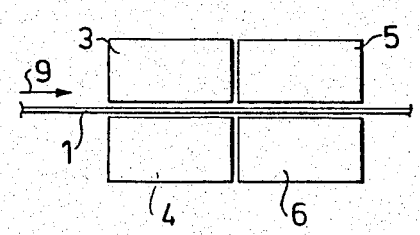
FIGS. 6 *a–d* show an operation cycle.
Figure 6B:
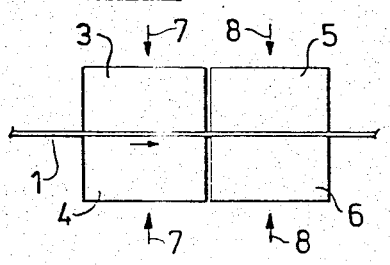
Figure 6C:
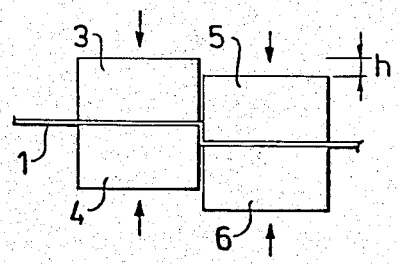
Figure 6D:
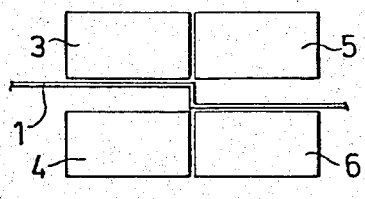

Hereby the sheet metal is advanced between the tools after each jag forming step, while a sufficient distance exists between opposite tools, parts, for example 5–15 mm, (see FIG. 6*d*).

The step-shaped jag 2 is formed, as mentioned, in that the preformed sheet is inserted between the two tool pairs 3, 4 and, respectively, 5, 6 (FIG. 6*a*) and held down between the same (FIG. 6*b*), whereafter the tool pairs are moved relative to each other in a direction perpendicular to the surface extension plane of the sheet 1 (FIG. 6*c*).

However, by the above described method an uncontrolled sliding movement occurs between the surfaces of the tools 3, 4, 5, 6 and the sheet 1. This sliding movement results in that the distance a, see FIG. 2, between two subsequent step-shaped jags 2 varies.

According to the present invention, the method of forming the step-shaped jags 2 is further carried out as follows.

When the sheet 1 has been preformed to wave-shape, for example sinus shape, the sheet is inserted between the two tool pairs 3, 4 and, respectively, 5, 6 in the direction of the arrow 9. In FIG. 6*a* this position is indicated schematically. Thereafter forces 7, 8 (FIG. 6*b*) are applied to all tools, so that each pair abut the sheet with a holding-down or clamping force.

The holding-down force,,i.e. the clamping force, in the first tool pair 3, 4, however, is different from that in the second tool pair 5, 6, in such a manner that the holding-down force 8 in the second tool pair 5, 6, i.e. the tool pair at the discharge end, is considerably higher than the holding-down force 7 in the first tool pair 3, 4.

After the application of the forces 7, 8 the tool pairs are moved relative to each other through a distance h, corresponding to the height of the desired step-shaped jag 2, see FIG. 6*c*, thereby forming the jag 2. The tool pair 5, 6 at the discharge end, according to a preferred embodiment, shall have a length corresponding to the distance a between two subsequent step-shaped jags.

The holding-down force 8 in the second tool pair 5, 6 is so adjusted that sliding movement between this tool pair 5, 6 and the sheet 1 is entirely prevented. The holding-down force 7 in the first tool pair 3, 4 further is so adjusted, that the sheet 1 starts sliding relative to the surfaces of this tool pair when owing to the relative movement between the tool pairs a certain tensile stress has been attained in the sheet.

The tensile stress in the sheet in a direction in parallel with vertical direction of the jag shall be lower than the tensile strength of the sheet material, but exceed the the yield strength thereof. It is hereby achieved that when the tensile stress has attained said level, the sheet starts sliding relative to the first tool pair 3, 4 instead of breaking, and continues to slide to an extent necessary for forming the jag 2.

Due to the fact that a tensile stress is produced in the sheet which is of a magnitude between the yield strength and the tensile strength of the sheet, and because the sheet is permitted to be fed to the zone in which deformation takes place, the sheet will be deformed, stretched, so that a jag will be formed betweeen the tool pairs. The angle of the plane surface with the direction of movement of the tool pairs depends on the distance between the tool pairs.

As all sliding movement of the sheet 1 occurs relative to the first tool pair 3, 4, the distance a between two subsequent step-shaped jags will always be the same. This in turn has the result, that every roofing element, which for example comprises five "tiles" in its width and five "tiles" in its longitudinal direction, will be substantially identical. When such elements are mounted to each other, a tight roof with adjacing elements accurately fitting each other as to their shape is obtained.

The aforesaid holding-down force 8 in the second tool pair 5, 6, i.e. the tool pair at the discharge end, is about 25% to 100% preferably about 50%, higher than the force 7 in the first tool pair 3, 4.

The holding-down force 7 in the first tool pair, of course, is to be adjusted according to the aforesaid, in which connection the properties of the sheet material, such as yield strength, tensile strength and friction properties against the tools are of decisive importance.

The relative movement between the tool paris 3, 4 and, respectively, 5, 6 according to the invention is effected, in that one tool in the tool pair 5, 6, preferably the upper tool 5, is loaded with an additional force corresponding to about 50% to 65% of the holding-down force 8 in the second tool pair.

When the jag 2 thus has been formed, the tools 3, 4, 5, 6 are separated from each other, as shown in FIG. *6d*, whereafter the sheet is advanced through a distance corresponding to the desired distance a between two subsequent step-shaped jags 2. Thereafter the next jag is formed.

According to a preferred apparatus to be used, each tool 3–6 is movable to and from the opposed tool, as stated above, by hydraulic piston cylinders 12–15, each of which is of a double-acting type. Therefore, there is to each cylinder 12–15 provided a first pipe 16–19 for moving the corresponding die toward the opposed die and a second pipe 20–23 for moving the corresponding die in a direction from the opposed die. Further, there is provided a valve 24–27 for each of the motors 12–15 which valves are supplied with pressurized oil from a pump 28 via a pipe 29. A drainage system 30, 31, 32, 33 is provided in a conventional manner, please see FIG. 9.

Referring to FIGS. *6b–6c*, all the cylinder 12–15 are first, see FIG. *6a*, pressurized via said first pipes 16–19. where the cylinders 14, 15 of the second tool pair 5, 6 are supplied with a higher pressure than the cylinders 12,13 of said first tool pair 3, 4, thereby obtaining a higher holding force in the second tool pair than in the first tool pair.

To operate the step according to FIG. *6c* the cylinders 12, 13 of the first tool pair 3, 4 are kept at a constant pressure, while the pressure in the cylinder 14 of the upper tool 5 of the second tool pair is brought to increase by controlling its corresponding valve 24. Hereby, the holding force will increase further, at the same time as the second tool pair 5, 6 will move downwards relative the first tool pair 3, 4, to the position illustrated in FIG. *6c*. While the upper cylinder 14 moves the second tool pair downwards, oil will be drained via pipe 19 connected to the cylinder 15 of the lower tool 6, at a predetermined pressure in pipe 19. Thereafter, all cylinders 2–15 are pressurized via the pipes 20–23 and the pipes 16–19 are drained to such extent that a sufficient distance between the tools is estalished for feeding the sheet metal in FIG. *6d* to the right.

It is obvious that the schematically described hydraulic system can be varied without changing the operational sequence with regard to the movements of the tools.

Further, the cylinder 13 may be deleted. In such case the lower tool 4 of the first tool pair is fixed. Still another modification is to replace the cylinder 15 connected to the lower tool 6 of the second tool pair with a spring adapted to give rise to the desired holding force in the second tool pair and adapted to allow said movement of the second tool pair 5, 6 relative to the first tool pair 3, 4.

The problems referred to in the introductory portion above, thus, are solved by the present invention.

It is, of course, possible according to the present invention to form sheets having other wave-shape than sinus-shape and also to use sheets of a material other than steel. In certain respects, aluminium sheet is preferred to steel sheet.

As regards the wave-shapes, it is possible, for example, to form curved portions and adjacent thereto plane portions.

Also the above stated dimensions and forces are to be regarded merely as examples, and they may vary depending on the desired configuration and sheet material.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A method of manufacturing a roofing of sheet metal, wherein a sheet is preformed so as by a first forming operation perpendicular to the surface extension the sheet is given a portion across the sheet curved to a configuration in the nature of a multiple wave, for example, a sinus-shape; the preformed sheet in a second operational step is provided with step-shaped jags of a predetermined step height by means of a pressing tool, having a feed end and a discharge end, which comprises at least one first and one second pair of tools, each pair having at least two parts, the parts of each pair being movable to and from one another; the preformed sheet being retained by each pair of tools in a clamping condition; whereafter, in a clamping condition, the tool pairs are moved relative to each other through a distance corresponding to the step height, so that the sheet by the second forming operation perpendicular to the surface extension of the sheet and across the wave configuration provided by said first forming operation is given a step-shaped portion; whereafter the tool pairs are moved to an unclamping condition and the preformed sheet is advanced through a predetermined adjusted distance; and thereafter a next step is formed, and so on, characterized in that: the parts of said second tool pair are located at the discharge end of the pressing tool and caused to hold-down the sheet with a clamping force so high that sliding movement between the sheet and the tool surfaces is prevented, and that said first tool pair is located at the feed end of the pressing tool and caused to hold down the sheet with a lower clamping force, which is adjusted to a predetermined value so that sliding movement between the sheet and the tool surfaces of the first pair occurs when a tensile stress has been attained in the sheet by the relative movement of the tool pairs which exceeds the yield strength of the sheet.

2. A method as defined in claim 1, characterized in that the clamping force in the second tool pair is caused to be about 25% to 100%, preferably about 50%, higher than the clamping force in the first tool pair.

3. A method as defined in claim 2, characterized in that the relative movement of the tool pairs is effected, and in that additional force is applied to one tool part of the second tool pair.

4. A method as defined in claim 2, characterized in that said predetermined distance is equal to the desired distance between two subsequent step-shaped jags in the feed direction of the sheet.

5. A method as defined in claim 1, characterized in that the relative movement of the tool pairs is effected, and in that additional force is applied to one tool part of the second tool pair.

6. A method as defined in claim 1, characterized in that said predetermined distance is equal to the desired distance between two subsequent step-shaped jags in the feed direction of the sheet.

7. A method as defined in claim 1, characterized in that the distance between the two tool pairs along the sheet extension exceeds the thickness of the sheet.

8. A method as defined in claim 7, wherein said distance between the two tool pairs is between two and ten times the sheet thickness.

9. A method as defined in claim 1, characterized in that said second tool pair has a length, which is equal to said predetermined distance between two subsequent step-shaped jags.

10. An apparatus for manufacturing a roofing of metal sheet by a stretch-pressing operation out of a preformed curved sheet metal, which has a wave shaped configuration, e.g. sinu-soidal, with full waves across the width to simulate appearance of tile, characterized in that; the apparatus comprises at least two pairs of tools, where each of the pairs comprises one lower part and one upper part and where the surface of each tool part facing the corresponding lower or upper part has a shape corresponding to the shape of the preformed sheet so that such a sheet can be retained or held in each pair of tools, i.e., between one upper and one lower part during a stretch pressing operation, and in that the pair of tools are movable a distance h in relation to each other and in that the movement between the pair of tools takes place in a plane perpendicular to the surface extension of a retained preformed sheet which results in steps being formed in the surface extension of and normal to the wave shaped configuration of the preformed sheet, said apparatus including means for causing the movement of one of the tool pairs relative to and independently of the other tool pair, and means for adjusting the clamping force in each of the pairs independently of the other pair.

11. An apparatus according to claim 10, characterized in, that: the apparatus comprises more than two pairs of tools, where each of pair of tools is movable a distance h in relation to its alignment condition relative to the adjacent preceeding pair of tools.

12. An apparatus according to claim 11, characterized in that: the tools are formed in such a way that the holding, i.e. the retaining force between the two parts of each pair of tools is varied across the wave-shaped section.

13. An apparatus according to claim 11, characterized in that: the tools are formed so that the height of the step is varied across the section.

14. An apparatus according to claim 11, characterized in that: the tools are formed in such a way that in certain places in that portion of the sheet which above has been called a step, a jag or an impression is made.

15. An apparatus according to claim 10, characterized in that: the tools are formed in such a way that the holding, i.e. the retaining force between the two parts of each pair of tools is varied across the wave-shaped section.

16. An apparatus according to claim 10, characterized in that: the tools are formed so that the height of the step is varied across the section.

17. An apparatus according to claim 10, characterized in that: the tools are formed in such a way that in certain places in that portion of the sheet which above has been called a step, a jag or an impression is made.

* * * * *